US006201513B1

(12) United States Patent
Ow et al.

(10) Patent No.: US 6,201,513 B1
(45) Date of Patent: Mar. 13, 2001

(54) COMPACT LOW PHASE ERROR ANTENNA FOR THE GLOBAL POSITIONING SYSTEM

(76) Inventors: Steven G. Ow, 1130 Coventry Dr., Thousand Oaks, CA (US) 91360; Peter J. Connolly, 588 Via Del Cerro, Camarillo, CA (US) 93010

( * ) Notice: Subject to any disclaimer, the term of this patent is extended or adjusted under 35 U.S.C. 154(b) by 0 days.

(21) Appl. No.: 08/917,238

(22) Filed: Aug. 25, 1997

(51) Int. Cl.[7] ..... H01Q 1/36
(52) U.S. Cl. ..... 343/895; 343/792.5
(58) Field of Search ..... 343/821, 895, 343/792.5, 846, 848

(56) References Cited

U.S. PATENT DOCUMENTS 3,555,554 * 1/1971 Kuo ..... 343/895
4,287,603 * 9/1981 Moser ..... 343/895
4,319,248 * 3/1982 Flam ..... 343/895
4,905,011 * 2/1990 Shea ..... 342/361
5,508,710 * 4/1996 Wang et al. ..... 343/895

FOREIGN PATENT DOCUMENTS

0080804 * 5/1982 (JP) ..... 343/895

* cited by examiner

*Primary Examiner*—Tan Ho
(74) *Attorney, Agent, or Firm*—William J. Benman

(57) ABSTRACT

A low phase error antenna. The antenna is adapted for use with the Global Positioning System and includes a spiral antenna for receiving electromagnetic energy at a first standard frequency (L1) and a second standard frequency (L2). The spiral antenna has a spiral element with a circumference greater than approximately one and a half times the wavelength of electromagnetic energy at the lowest frequency (L2). The cavity of the antenna is unloaded and includes a balun adjusted for zero squint. The antenna element is either a logarithmic spiral or an archimedian spiral. In the illustrative embodiment, the spiral antenna includes a cavity having a depth which varies in accordance with the received electromagnetic energy. The cavity is approximately ¼ of a wavelength deep at the positions along spiral that receive electromagnetic energy.

14 Claims, 3 Drawing Sheets

COMPACT LOW PHASE ERROR ANTENNA FOR THE GLOBAL POSITIONING SYSTEM

BACKGROUND OF THE INVENTION

1. Field of Invention

This invention relates to the Global Positioning System (GPS). Specifically, the present invention relates to low phase error antennas for receiving GPS signals.

2. Description of the Related Art

The Global Positioning System is used in a variety of demanding applications ranging from geological surveys, to military positioning applications. Such applications require accurate antennas to precisely determine distances and positions with sub-millimeter accuracy.

The Global Positioning System includes a constellation of satellites equipped with GPS transmitters. A ground receiver receives signals from the satellites. By measuring signal travel time from the satellites to the phase center of the ground receiver's antenna, the position of the ground receiver may be determined. The phase center of the antenna corresponds to the point at which the antenna appears to receive a spherical wavefront. The phase center may be different than the physical center of the antenna.

Often, the phase center of the antenna does not correspond the physical center of the antenna due to multipath errors and/or phase errors. Typical GPS antennas are either dual frequency patch antennas or cross dipole antennas which are particularly prone to phase and multipath errors. Multipath errors occur when signals transmitted from the GPS satellites reflect off hills or objects and combine. The combined signal is received by the ground receiver and results in an effective electrical position that erroneously moves with satellite transmit location. An antenna with a receive pattern that extends well below horizontal may more readily detect such combined reflected signals. An antenna with such a receive pattern is said to have a large backlobe and is more susceptible to multipath problems.

Phase errors are inherent in certain antenna element designs such as patch antenna designs. Other phase errors occur due to manufacturing tolerance such as in cross dipole designs. Phase errors cause the phase center of a stationary ground antenna to move with satellite position. The effective phase center of patch antennas and cross dipole antennas often vary with GPS satellite position due to antenna structure and manufacturing error respectively.

To reduce multipath errors choke slot groundplanes were developed. Choke slots are highly reactive devices at the design frequency which when installed on a GPS antenna reduce antenna surface currents and re-radiation. The reduced surface currents may result in a decreased antenna backlobe and reduced multipath errors. The antenna is said to have improved multipath rejection. GPS antennas that employ choke slots are often large and expensive as a result of structural limitations.

To reduce phase errors associated with existing GPS antennas a method known as observation differencing was developed. Observation differencing involves canceling phase errors through the introduction of compensation variables. This method requires antennas in the GPS system to be of the same make and model. The method relies on the assumption that antennas of the same make and model behave similarly. The lack of consistency between such antennas limits the effectiveness of observation differencing in canceling phase errors. This lack of consistency is partially due to manufacturing inconsistencies due to difficult tooling procedures.

Hence, a need exists in the art for a cost effective, compact antenna that minimizes phase and multipath errors. There is a further need for antenna that provides for tooling procedures that result in antennas with similar and consistent performance.

SUMMARY OF THE INVENTION

The need in the art is addressed by the low phase error antenna of the present invention. In the illustrative embodiment, the inventive antenna is adapted for use with a global positioning system and includes a spiral antenna for receiving a signal at a first frequency and/or a second frequency. The spiral antenna has a spiral element with a circumference greater than approximately one and one-half times the wavelength of the signal received at the lowest frequency.

In a specific embodiment, the first frequency and the second frequency are the standard L1 and L2 frequencies respectively. The cavity of the spiral antenna is unloaded and includes a Marchand balun adjusted for no squint. The spiral antenna element is either a logarithmic spiral or an archimedian spiral.

In the illustrative embodiment, the spiral antenna includes a cavity having a depth which varies in accordance with the radiated GPS frequencies. The cavity is approximately ¼ of a wave deep at the position along the spiral that receives the radiated electromagnetic energy.

The novel design of the present invention is facilitated by the use of tooling markers on the surface of the antenna which ensure consistent manufacturing and performance.

BRIEF DESCRIPTION OF THE DRAWINGS

FIG. 2(*b*) is a close up view of a portion of the diagram of FIG. 2(*a*).

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
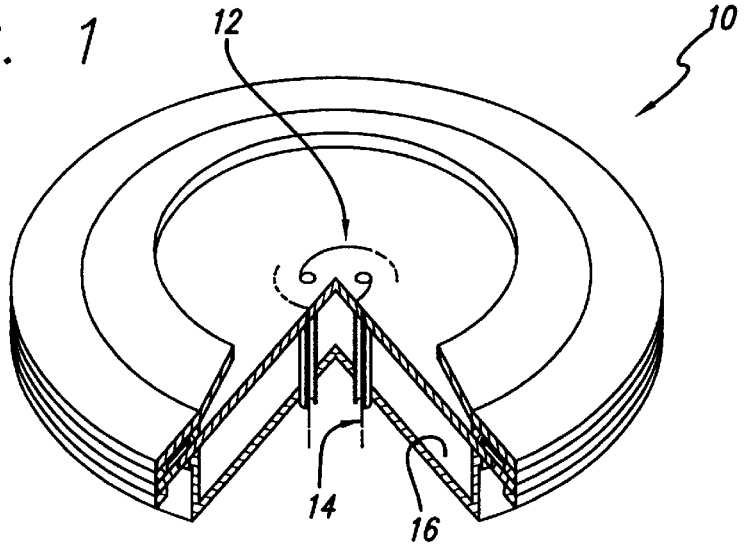
FIG. 1 is a cut-away diagram of an antenna constructed in accordance with the teachings of the present invention.

FIG. 1 is a cut-away diagram of an antenna 10 constructed in accordance with the teachings of the present invention. The antenna 10 is constructed of aluminum or other suitable material. The antenna 10 has antenna elements or spiral arms 12. The spiral arms 12 are fed by a conventional balun 14 having minimum squint. Minimum squint baluns help contribute to a desirable symmetric radiation pattern that does not lean to one side or the other.

In transmit mode, the spiral arms 12 radiate electromagnetic energy communicated to the arms 12 via balun 14. In receive mode, the spiral arms 12 receive electromagnetic energy which is then communicated to the balun 14. The spiral arms 12 are designed to accommodate electromagnetic energy having a frequency of approximately 1575.42 MHz (L1) and electromagnetic energy having a frequency of approximately 1227.6 MHz (L2). The L1 and L2 frequencies are the principle frequencies used for precision GPS surveying.

When the antenna 10 is in transmit mode, some electromagnetic energy will radiate outward from the antenna 10 as a transmitted wave. In the present specific embodiment, the transmitted wave is right hand circularly polarized. A left hand circularly polarized wave travels back into an unloaded antenna cavity 16. The cavity 16 may be filled with a material other than air. The material may have a dielectric constant of approximately 1 and still be considered unloaded. The depth of the cavity 16 is approximately ¼ (90°) of the wavelength of electromagnetic energy being radiated or received. The left hand circularly polarized wave is out of phase with the transmitted circularly polarized wave by 180 degrees. When the left hand circularly polarized wave travels ¼ (90°) to the back wall 18 of the cavity 16, it reflects off the wall 18 and switches to right hand circular polarization. The wave reflected off the back wall 18 travels another ¼ (90°) back toward the spiral element 12 and is in phase with the transmitted right hand circularly polarized wave, and has equivalent polarization. The reflected wave then adds with the transmitted wave, increasing the gain of the antenna 10 by approximately 3 dB. Typical spiral antennas have loaded cavities. A loaded cavity has an electromagnetic energy absorber or dielectric that is placed or loaded in the cavity 16 to increase the bandwidth of the antenna for broad band applications for which spiral antennas are known. Unloading the cavity for GPS applications allows for increased gain and a reduced radiation pattern backlobe which corresponds to better multipath rejection.

Spiral antennas are typically used for large bandwidth applications such as in military radar detection systems. Such antennas, however, have been overlooked for GPS applications due to a lack of general knowledge on the applicability of large diameter (versus wavelength) spiral antennas to GPS systems.

Those skilled in the art will appreciate that the balun 14 may be an infinite, printed-circuit, lumped-constant, or matrix excited balun, or another type of balun having low squint without departing from the scope of the present invention.

Figure 2A:
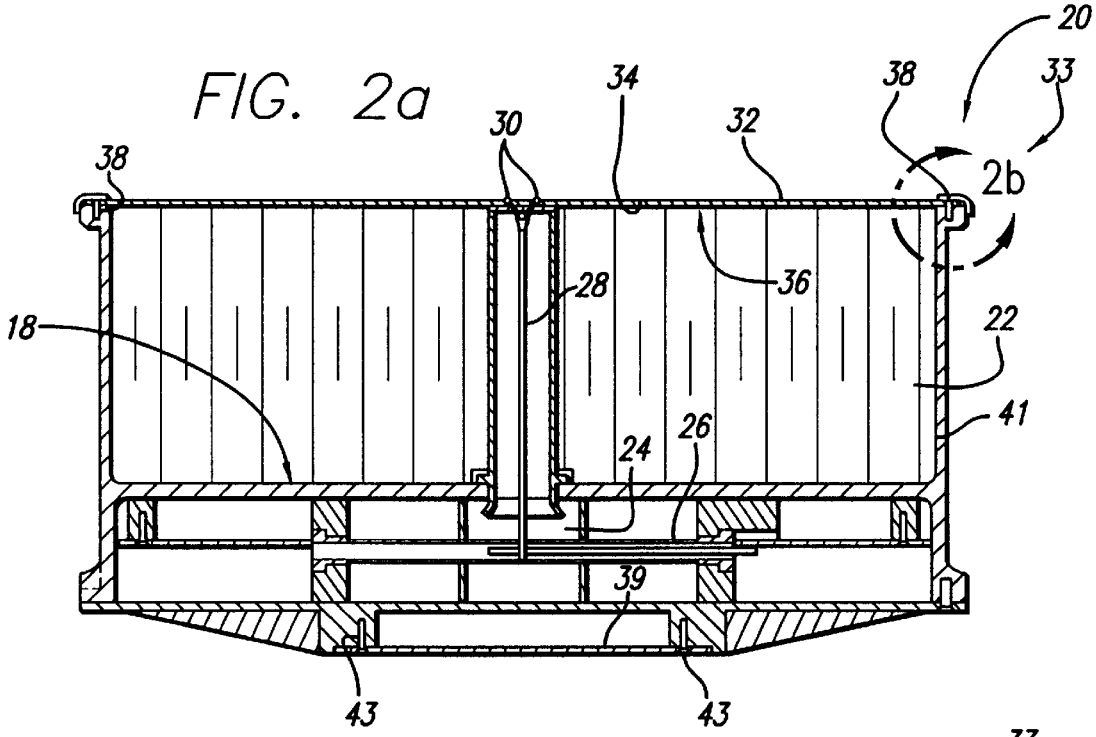
FIG. 2(*a*) is a cross-sectional diagram of an alternative embodiment of the present invention showing the unloaded cavity.
Figure 2B:
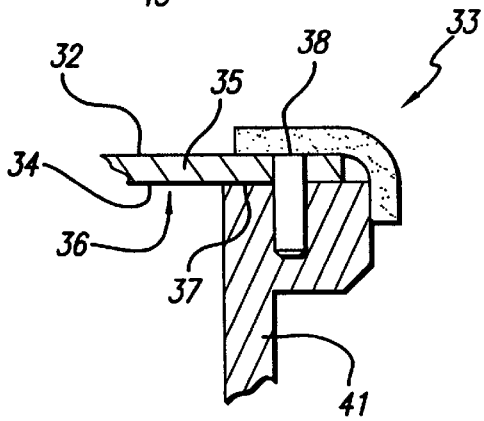

FIG. 2 is a cross-sectional diagram of an alternative embodiment 20 of the present invention. The antenna 20 includes an unloaded cavity 22 approximately ¼ wavelength in depth. A Marchand balun 24 is included and has no squint for achieving symmetrical radiation patterns. Techniques for incorporating Marchand baluns without squint are well known. The Marchand balun includes a coaxial portion 26 connected to a stripline 28 that directs electromagnetic energy to dual spiral feeds 30 of the spiral antenna 20. As discussed below, the dual spiral feeds feed a dual spiral element etched on a surface 32 of the antenna 20. Those skilled in the art will appreciate that the antenna 20 may be fed from the periphery rather than the center of the antenna 20 without departing from the scope of the present invention.

The spiral element is etched on the surface 32. FIG. 2(*b*) is a close up view of a portion 33 of the diagram of FIG. 2(*a*). The surface 32 is supported by a thin dielectric substrate 36 of precision controlled thickness which has a dielectric reference surface 34. The dielectric substrate 36 is supported by a precision machined metallic reference surface 37 which is part of an antenna housing 41. The reference surface 34 and the metallic reference surface 37 are coplanar.

In the preferred embodiment, as shown in FIG. 2(*a*), the dielectric reference surface 34 is also supported by a honeycomb material that has a dielectric constant of 1 and is precision machined to a thickness to occupy the cavity 22 to match the height of the metallic reference surface 37 (see FIG. 2(*b*)) and the dielectric reference surface 34. This honeycomb material helps to consistently position the spiral element in elevation above the reference plane 34 and prevents undesirable sagging of the dielectric substrate 36. This, in turn, provides for consistently manufactured spiral antennas.

To further aid in manufacturing consistency, the antenna 20 includes reference pins 38 used to consistently position the reference plane substrate 36 on the antenna 20. The pins 38 are aligned with tooling holes (see FIG. 3) in the reference plane substrate 36. This helps to ensure that the spiral element is centered over a master reference surface 39.

The master reference surface 39 is a precision machined surface displaced a known distance from the metallic reference surface 37 (see FIG. 2(*b*)). This establishes a precision height of the spiral element above the master reference plane 39. The master reference surface 39 is centered relative to the reference pins 38. This keeps the spiral element on the surface 32 centered relative to the center of the master reference plane 39. The centering of the master reference surface 39 relative to the tooling pins 38 is facilitated by bolt holes 43 in the master reference surface 39. The bolt holes 43 may be accurately positioned relative to the reference pins 38 using conventional CNC machinery so that the master reference surface 39 is concentric with the dielectric surface 34, the substrate 36, and the spiral element feeds 30.

The L1 and L2 frequencies will be received on the spiral elements (see FIG. 3) at different positions along the spiral elements. For example, electromagnetic energy received at the L1 frequency will occur at a first diameter and electromagnetic energy received at the L2 frequency will occur at a second diameter. The depth of the cavity 22 may be varied so that at the first diameter the depth of the cavity is approximately ¼ of the wavelength of the energy received at the L1 frequency and at the second diameter, the depth of the cavity is approximately ¼ of the wavelength of the energy received at the L2 frequency (see FIGS. 4 and 5). This will cause both phase centers corresponding to the received wave and the wave reflected off the back wall of the cavity to be coincident which will enhance the overall system performance.

Figure 3:
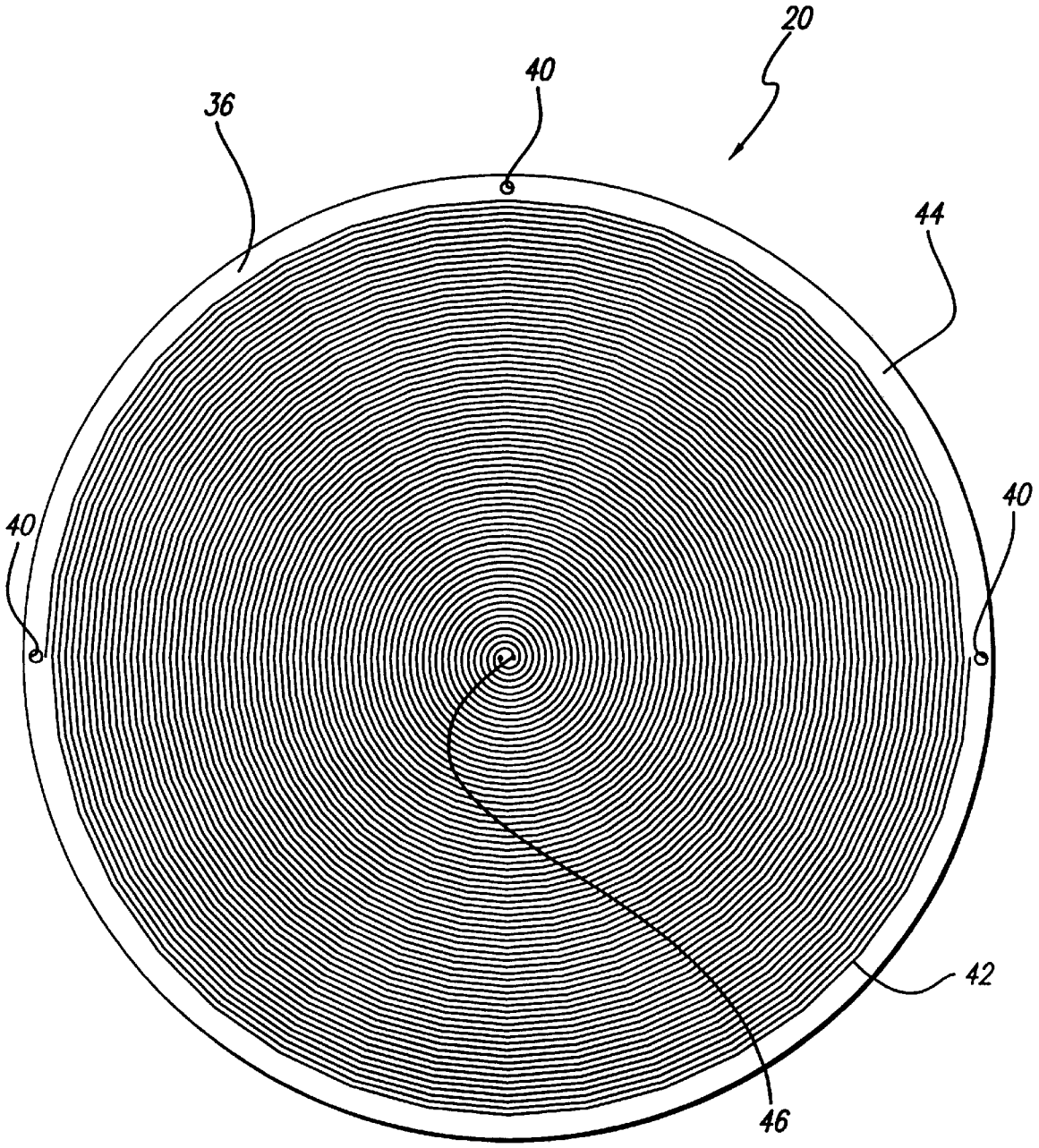
FIG. 3 is a top view of the spiral antenna of FIG. 2 showing tooling holes and the etched spiral element.

FIG. 3 is a top view of the spiral antenna 20 of FIG. 2 showing alignment tooling holes 40, feed tooling holes 46 and an etched spiral element 42. The tooling holes 40, 46 provide for consistent manufacturing which results in antennas having similar receive patterns and low phase error properties.

The technique of observation differencing may be more effective at canceling any remaining phase errors when existing antennas are replaced by consistently manufactured spiral antennas. Conventional dual frequency patch or cross-dipole antennas typically lack convenient mechanisms to ensure very consistent manufacturing.

The spiral element 42 is an archimedian spiral and extends close to an edge 44 of the antenna 20. Those skilled in the art will appreciate other types of spiral elements such as log spiral or equiangular spiral elements may be used for this purpose without departing from the scope of the present invention. Also, the spiral element may be a hybrid element 42, such as a combination of an archimedian, log, and/or equiangular spiral.

The circumference of the spiral element 42 enclosed by the edge 44 is approximately twice of the wavelength of electromagnetic energy to be received by the antenna. In the present embodiment the circumference is approximately twice the wavelength of electromagnetic energy received at the L2 frequency. In the illustrative embodiment, the spiral element 42 has a diameter of at least 1¾ of the wavelength of the electromagnetic energy at L1 or L2. At GPS frequencies, this diameter will typically be at least four inches. Those skilled in the art will appreciate that a larger antenna diameter may be used for this purpose without departing from the scope of the present invention.

When manufacturing the spiral antennas of the present invention, a series of steps are performed. First, the top surface (see 32 of FIG. 2) of the dielectric substrate 36 is manufactured from dielectric material. The reference surface is circular and flat having very small, predetermined tolerances. The precision machining of such flat, circular surfaces is well known in the art.

Next, a computer numerical control (CNC) drill is programmed to drill the tooling holes 40, 46 in the substrate 36. The holes are drilled and the spiral element artwork is optically aligned and etched on the substrate 36.

The dielectric substrate 36 is a copper coated dielectric material. The artwork includes a design of the spiral element with feed holes coinciding with the feed holes already drilled in the reference plane substrate 36. The design is then optically aligned with the substrate 36 so that artwork feed holes are aligned with the feed holes already drilled in the substrate 36. This optical aligning may be performed using conventional optical aligning techniques used in integrated circuit manufacturing processes. Next, the spiral element design is etched in the copper of the substrate 36 using conventional circuit board etching procedures, which include the application of photo-resist, ultraviolet light exposure, and etching.

Finally, the prepared reference plane substrate 36 is placed on a precision machined spiral antenna body (see 41 of FIG. 2) and aligned with tooling pins (see 38 of FIG. 2) thereon. The tooling pins coincide with the tooling holes 40 and are also positioned with the aid of a CNC machine.

A method for manufacturing a spiral antenna according to the teachings of the present invention comprises the steps of:

1. Machining the structural components of a spiral antenna including a cavity, and an antenna reference plane from aluminum.

2. Storing information relating to a desired position of the spiral element on the surface of the spiral antenna in a memory associated with a CNC drill.

3. Using the CNC drill to drill spiral element alignment tooling holes and element feed tooling holes in the surface in accordance with the information stored in memory.

4. Developing a mask of the spiral element to be etched on the surface of the antenna to fit the tooling holes. The mask is designed so that the spiral element has the necessary number of turns to radiate or receive at the L1 or L2 frequencies, or both.

5. Using the mask to etch the cement from a copper sheet using conventional integrated circuit manufacturing methods on the surface so that the spiral feeds are aligned with the feed tooling holes, and the spiral element is aligned with the alignment tooling holes.

Figure 4:
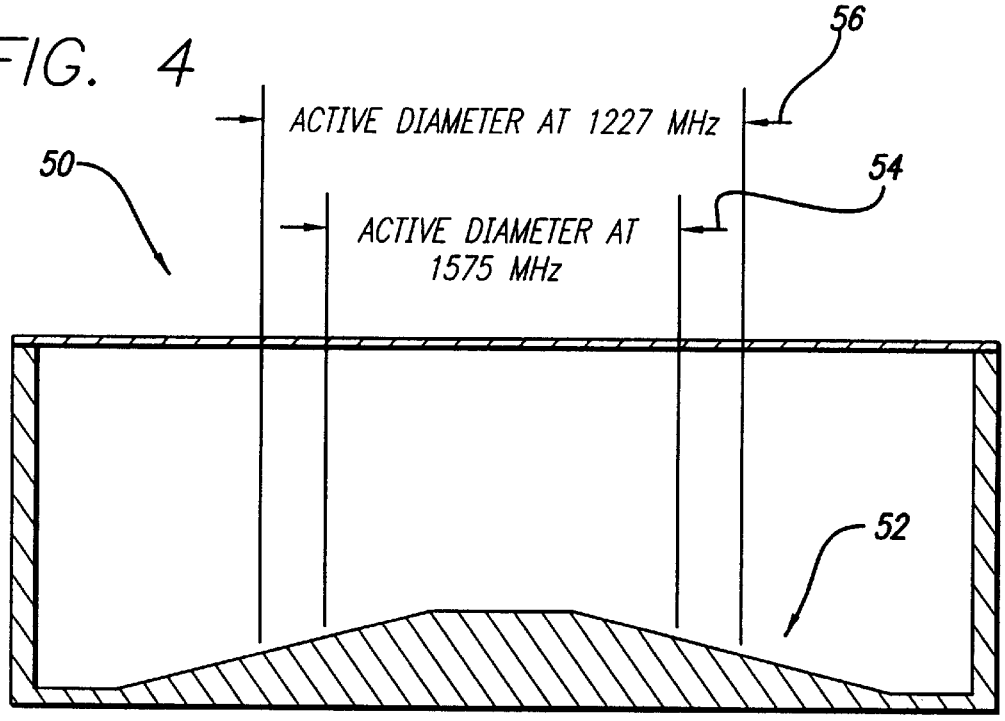
FIG. 4 is a cross-sectional diagram of a first alternative spiral antenna cavity constructed in accordance with the teachings of the present invention.

FIG. 4 is a cross-sectional diagram of a first alternative spiral antenna cavity 50 constructed in accordance with the teachings of the present invention. The antenna cavity 50 has a conical back plane 52 causing the cavity 50 to vary in depth as a function of diameter.

Electromagnetic energy radiates from a spiral element at a different diameters for different frequencies of electromagnetic energy. At an L1 diameter 54 at which electromagnetic energy having a frequency of approximately 1575.4 MHz radiates from the spiral element (see FIG. 3), the cavity is ¼ of the wavelength of the electromagnetic energy. Similarly, at a L2 diameter 56, the depth of the cavity is approximately ¼ of the wavelength of electromagnetic energy having a frequency of approximately 1227.6 MHz.

Figure 5:
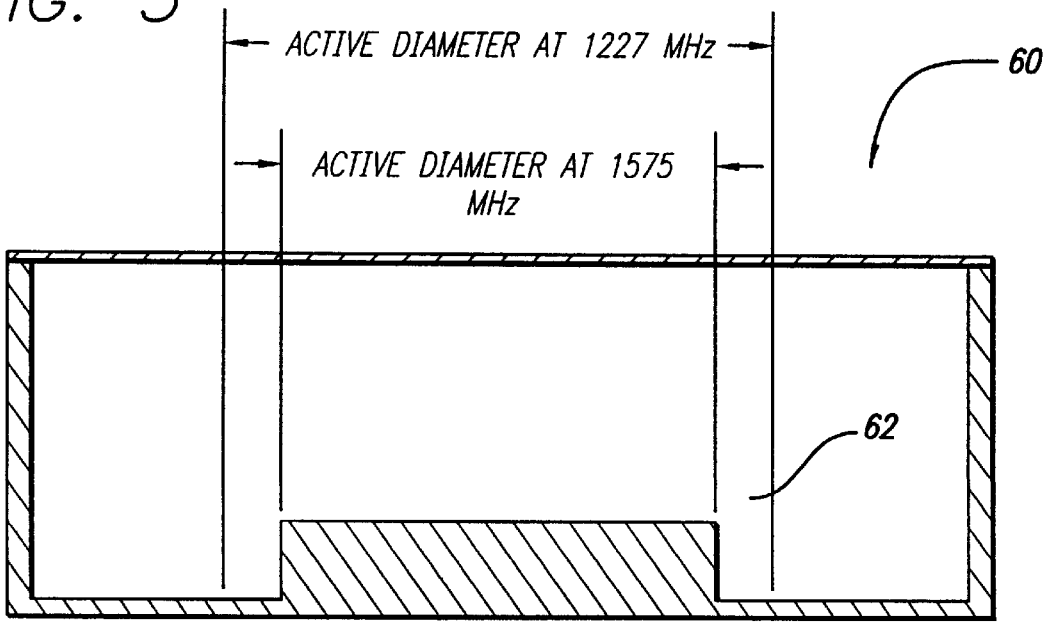
FIG. 5 is a cross-sectional diagram of a second alternative spiral antenna cavity constructed in accordance with the teachings of the present invention.

FIG. 5 is a cross-sectional diagram of a second alternative spiral antenna cavity 60 constructed in accordance with the teachings of the present invention. Like the cavity 50 of FIG. 4, the cavity 60 has a depth that varies so that the depth at a particular diameter is ¼ of the wavelength of electromagnetic energy radiated or received at that diameter. Since there are only two principle frequencies L1, and L2 there is one step 62 in the cavity 60.

Those skilled in the art will appreciate that the depth of the cavity 60 may be continuously varied across the entire antenna diameter so that at each position along a spiral element (see FIG. 3) the cavity 62 is ¼ of the wavelength of electromagnetic energy that may be radiated or received from that position, without departing from the scope of the present invention.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. An antenna adapted for use with global positioning systems comprising:

a support structure, said support structure having an unloaded cavity for enhancing the gain of a received signal and spiral antenna means mounted on said support structure for radiating or receiving electromagnetic energy at a first frequency and for radiating or receiving electromagnetic energy at a second frequency, said first frequency being approximately 1575.4 MHz and said second frequency being approximately 1227.6 MHz, said spiral antenna means having a spiral element with a circumference greater than approximately one and one half times the wavelength of said electromagnetic energy.

2. The invention of claim 1 wherein said support structure includes a cavity with a first depth that is approximately ¼ of a wavelength deep below the position along said spiral that receives said electromagnetic energy at said first frequency and a second depth that is approximately ¼ of a wavelength deep below the position along said spiral that receives said electromagnetic energy at said second frequency.

3. The invention of claim 2 wherein said cavity includes a conical ground plane.

4. The invention of claim 2 wherein said cavity includes a stepped ground plane.

5. The invention of claim 1 wherein said antenna includes tooled markers for ensuring a properly aligned spiral element.

6. The invention of claim 5 wherein said tooled markers include element feed tooling holes to provide for consistent positioning of spiral feeds of said spiral element on a surface of the spiral antenna means.

7. The invention of claim 5 wherein said tooled markers include element alignment tooling holes placed near the periphery of the spiral element.

8. The invention of claim 1 wherein said spiral antenna means includes a Marchand balun adjusted for zero squint.

9. The invention of claim 1 wherein said spiral element is a logarithmic spiral element.

10. The invention of claim 1 wherein said spiral element is an archimedian spiral element.

11. The invention of claim 1 wherein said spiral element is an equiangular spiral element.

12. The invention of claim 1 wherein said spiral element is a hybrid spiral element including 2 or more types of elements.

13. The invention of claim 1 wherein said spiral element is larger than four inches.

14. A low error spiral antenna for global positioning system applications comprising:

a spiral element having sufficient turns for broadcasting electromagnetic energy at an L1 and/or L2 global positioning system frequency, said spiral element having a diameter of at least 1¾ the wavelength of said electromagnetic energy;

an unloaded spiral cavity having a depth of ¼ of the wavelength of said electromagnetic energy at the position along said spiral element that receives said electromagnetic energy; and balun means for delivering said electromagnetic energy to said spiral element with minimum squint.

* * * * *